United States Patent [19]

Wells

[11] 4,383,917

[45] May 17, 1983

[54] APPARATUS FOR CLASSIFYING AIRBORNE PARTICULATE MATTER

[75] Inventor: Howard M. Wells, Salt Lake City, Utah

[73] Assignee: University of Utah, Salt Lake City, Utah

[21] Appl. No.: 280,591

[22] Filed: Jul. 6, 1981

Related U.S. Application Data

[63] Continuation-in-part of Ser. No. 187,357, Sep. 15, 1980, abandoned.

[51] Int. Cl.[3] ..... B04C 3/06

[52] U.S. Cl. ..... 209/144; 209/211

[58] Field of Search ..... 209/143, 144, 211, 459, 209/142, 145, 133–137; 210/512.1, 304; 55/461, 338

[56] References Cited

U.S. PATENT DOCUMENTS

| | | | |
|---|---|---|---|
| 496,897 | 5/1893 | Rathbun | 55/338 X |
| 1,023,750 | 4/1912 | Morscher | 209/144 |
| 1,264,023 | 4/1918 | Davis | 209/142 |
| 1,505,741 | 8/1924 | Stebbins | 209/144 |
| 2,044,915 | 6/1936 | Mosley | 209/144 |
| 2,584,976 | 2/1952 | Bailey | 209/211 |
| 2,696,911 | 12/1954 | Umney | 209/142 |
| 2,716,002 | 8/1955 | Craig | 241/43 |
| 3,002,472 | 10/1961 | Miller | 110/106 |
| 3,010,576 | 11/1961 | Harte et al. | 209/35 |
| 3,043,525 | 7/1962 | Gilbert | 241/30 |
| 3,415,375 | 12/1968 | Wikdahl | 209/211 |
| 3,640,016 | 2/1972 | Lee et al. | 44/1 |
| 3,909,212 | 9/1975 | Schroeder | 44/1 |
| 3,917,465 | 11/1975 | Meyers | 44/2 |
| 4,159,942 | 7/1979 | Greer et al. | 209/143 |

FOREIGN PATENT DOCUMENTS

| | | | |
|---|---|---|---|
| 1919734 | 9/1934 | Australia | 209/211 |

*Primary Examiner*—Ralph J. Hill

*Attorney, Agent, or Firm*—H. Ross Workman; Allen R. Jensen; Drew S. Hamilton

[57] ABSTRACT

An apparatus is provided for classifying and separating larger or more dense particles from fine particulate material entrained in a stream of air. The apparatus has a helically-shaped air chamber with a truncated frusto-conically shaped circumferential periphery. A series of extraction ports are disposed at spaced intervals along the truncated apex of the periphery. An adjustable blade means disposed at each extraction port segregates the outer fraction of particles from the air stream and diverts it into an extraction chamber surrounding the extraction port. The extraction chamber is pressurized to prevent the outflow of air from the helically-shaped air chamber through the extraction port and to remove the extracted particles to a collection point for further processing.

23 Claims, 8 Drawing Figures

APPARATUS FOR CLASSIFYING AIRBORNE PARTICULATE MATTER

RELATED APPLICATION

This application is a continuation-in-part of my copending U.S. patent application Ser. No. 187,357, filed Sept. 15, 1980, now abandoned.

BACKGROUND

1. Field of the Invention

The present invention relates to a method and apparatus for effecting separation of airborne particulate matter by size and/or density through the use of centrifugal force.

2. The Prior Art

Many industrial situations require the separation of airborne particulate matter on the basis of size or density. For example, in the mining industry, dry milling of rock requires closed circuit recirculation of over-sized particles for regrinding. It is, therefore, necessary to separate the over-sized particles from the smaller ground particles which are allowed to pass from the grinding phase of processing.

The separation of airborne particulate matter is also an important and highly desirable component of steam boiler systems which are fired by pulverized coal. Large scale coal fired steam boiler systems are very commonly used in the generation of electrical power by electric utilities. As will be discussed hereafter, the completeness of the separation of undesirable and inert materials from the pulverized coal can have a direct effect upon the operating efficiency and the economics of the electric generating plant.

Coal is not a uniform substance but is a mixture of components that vary in both physical and chemical composition. There are two major types of impurities in coal which are of particular concern to industries which use coal as a fuel: (1) impurities which constitute what is known as ash, and (2) impurities which contain sulfur. If these impurities could be removed from the coal prior to its combustion great savings could be realized both economically and environmentally.

By removing the ash impurities, the purity of the coal is greatly enhanced so that there is more complete burning of the fuel. Furthermore, greater efficiency in the operation of the boiler system is obtained because it is not necessary to heat the ash impurities up to the combustion temperature of coal. In addition, by removing sulfur-containing impurities, the effluent gases resulting from the combustion of the coal fuel are much cleaner, thus requiring less expensive and sophisticated means for recovering and removing impurities from these effluent gases.

In the past, numerous attempts have been made to provide a system for separating particulate matter for applications such as those described above. Many of these methods have used centrifugal force as part of the means for separating the impurities. See, for example, U.S. Pat. No. 496,897 to Rathbun and Australian Pat. No. 19,197/34 to Lawrie et al.

The use of centrifugal force in the separation process is particularly well suited for applications requiring the use of coal. This is because it is well known that the impurities associated with the coal are generally more dense than the coal itself. However, the devices and methods of the prior art have been only partially successful, at best, in separating the larger and more dense particles (that is, having a greater mass) from the smaller and less dense particles (that is, having a lower mass), as is required in the above-described processing of coal. The prior art devices and methods have either left some of the larger or more dense impurity particles in the system, or have collected an unacceptably large portion of the smaller, less dense coal particles along with the larger or more dense impurity particles.

The problems experienced by devices which have used centrifugal force in the past have been varied, but the inadequate results have mainly stemmed from two important factors. First, when acted on by centrifugal forces, all particles having density or appreciable size are caused to migrate toward the outer portion of the curved surface along which they are traveling. Although the larger and more dense particles tend to migrate to this surface faster than the lighter and less dense particles, there is no clear separation point between the layers of particles which are desired to be separated from the layers of particles which are desired to be retained. This problem is magnified by the fact that as total concentrations of particles change (for example, the percentage of impurities in the coal vary), the depth of particle layers along the outer surface also changes.

The other major factor which has hampered prior art devices and methods in separating particles is that, as particles are accelerated through an enclosed, curved conduit, pressures within the conduit are increased. As a result, a significant pressure differential is created between the interior of the conduit and the exterior atmospheric pressure. Many prior art devices for separating particles by use of centrifugal force have generally involved the extension of a blade member through a port in the outer conduit surface into the pathway of particles traveling within the conduit. The blade member deflects particles near this outer surface through an exit port which opens into a collection chamber at atmospheric pressure. Unfortunately, the effects of the pressure differential between the conduit interior and the atmosphere are seen through the port.

The result of this pressure differential is that, in addition to transmitting the larger sized impurity particles through the port, air also flows from the higher pressure conduit interior to the lower pressure collection chamber. The air rushing through the port naturally draws with it many smaller and less dense particles which are not intended to be included in the separated particlate matter. This undesirable removal of the lighter particles greatly reduces the ability of these systems to improve the operating economy and efficiency associated with large, coal burning furnaces.

Furthermore, in situations of higher impurity particle concentration, it is often the case that significant quantities of impurities remain in the system because these impurities may pass beyond the reach of the inserted blade member even though the outward flowing air still carries away the lighter and less dense particulate matter. These and other problems experienced in the prior art can be more clearly understood by reference to specific prior art devices which are described in greater detail hereinafter.

One attempted method for solving the problem caused by the varying concentrations of particulate matter has been to employ blade means whose length of extension into the conduit interior is adjustable. See, for example, U.S. Pat. No. 2,044,915 to Mosley. Although only manual adjustability has been provided in the past, even automatic adjustability would not provide a full resolution of the problem. This is because there is no identifiable separation level between the larger or more dense particles and the smaller or less dense particles. In addition, such prior methods have also failed to even address the pressure differential problem.

Recognizing, at least to a limited extent, the problems caused by the pressure differential at the extraction port, several separating devices have attempted to solve the serious problem, albeit unsuccessfully, of the loss of the smaller or lighter particles due to the air blast through the port. Such devices have utilized the transmission of a stream of air into the interior of the conduit near the extraction port so that the smaller, less dense particles are deflected away from the port opening by the incoming stream of air. Examples of such proposed devices are seen in U.S. Pat. Nos. 1,505,741 to Stebbins and 1,023,750 to Morscher. The problem with this attempted solution is that it not only deflects the smaller, lightweight particles from the opening, but it also tends to deflect some of the larger particles, thereby reducing the efficiency of the separation process. In addition, there are significant costs in the operation of a device which uses such an incoming stream of air.

As is apparent from the above discussion, what is needed in the art is a device and method utilizing centrifugal force for the separation of larger or more dense particles from smaller or less dense particles in a conduit, without being subject to the adverse effects of a pressure differential at the extraction point. A further improvement in the art would be to provide a system which is capable of separating substantially all of the more dense impurity particles without additional loss of the smaller coal particles. Such a device and method is disclosed and claimed herein.

BRIEF SUMMARY AND OBJECTS OF THE INVENTION

An air stream containing randomly sized, suspended particles is forced under pressure into a spiral or helically-shaped air passage. The helically-shaped air passage is frusto-conical in cross-section, having its truncated apex forming the outer periphery of the air passage.

A sense of extraction ports fitted with adjustable cutting blades are periodically disposed along the length of the outer periphery of the air passage. These extraction ports lead to one or more collection chambers for the extracted material. The cutting blades are adjustable so that the depth of cut into the flow of particles through the air passage can be increased or decreased according to the requirements of the size or density of the particles to be extracted. The cutting blade in the last of the series of extraction ports is extended well into the spiral flow of particles such that essentially all remaining particles of extractable size are extracted. Since this last blade also extracts a portion of the less dense particles, the last extracted mixture is recycled back to the front end of the spiral air passage.

The velocity of the air stream is sufficient to create turbulent air flow as well as creating a continuous centrifugal force within the passage. This air stream velocity is such that the larger or more dense particles in the air current have sufficient momentum to be forced outwardly by the centrifugal force toward the circumference of the spiral passage. However, the eddy currents set up by the turbulent air flow cause the smaller or less dense particles to remain suspended in the airstream, generally away from the outer circumference of the spiral passage.

The sum of the static and dynamic air pressures encountered within the helically-shaped air passage would be expected to be greater than the pressures in the collection chamber, but this pressure difference is eliminated by the present invention. The loss of significant amounts of entrained fine particles through the extraction port is prevented by counterbalancing the air pressure within the air passage with an independently induced air pressure in the collection chamber surrounding each extraction port. The induced air pressure inside the collection chamber serves a dual propose: (1) it provides air pressure equalization to prevent loss of entrained particles through the extraction port, and (2) it conveys the extracted particles from the extraction port to a collection point for further processing.

It is therefore a primary object of the present invention to provide an improved centrifugal separator for separating airborne particulate matter wherein the effects of pressure differential between the centrifuge chamber and the extraction chamber are substantially eliminated.

Another object of the present invention is to provide an improved centrifugal separator for separating airborne particulate matter which prevents the undesirable extraction of particles from within the centrifuge chamber by air flow from the centrifuge chamber to the extraction chamber.

A further object of the present invention is to provide an improved centrifugal separator for separating particular classes of airborne particles from within the centrifuge chamber without significant interference with the air flow within the centrifuge chamber.

Still another object of the present invention is to provide an improved centrifugal separator for separating a significant portion of the impurity particles associated with pulverized coal in large scale boiler furnaces so as to increase both the economy of furnace operation and the environmental quality of the effluent gases from the boiler furnaces.

These and other objects and features of the present invention will become more fully apparent from the following description and appended claims taken in conjunction with the accompanying drawings.

DETAILED DESCRIPTION OF THE PREFERRED EMBODIMENT

Figure 1:
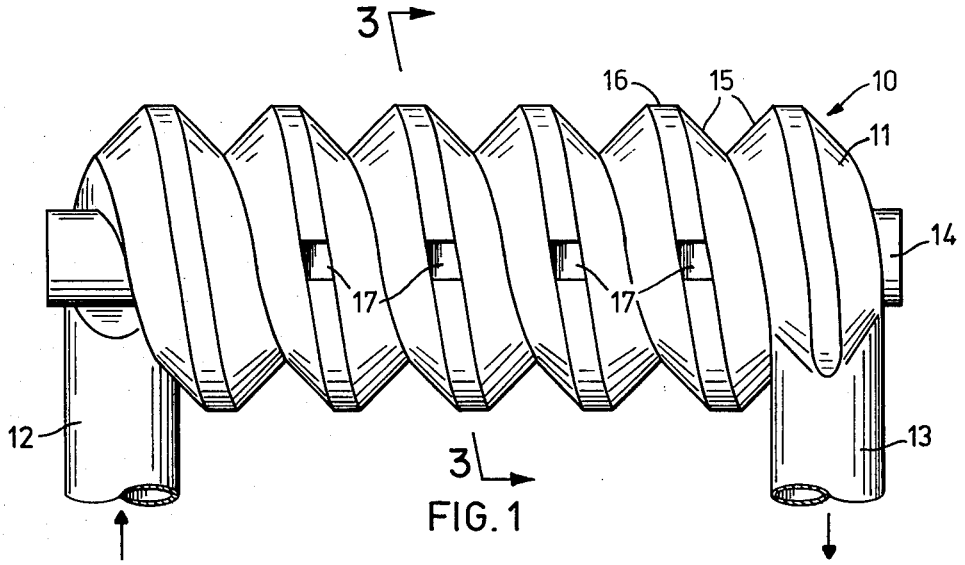
FIG. 1 is a side elevational view of the helically-shaped air passage of one preferred embodiment of the present invention.

Reference is now made to the figures, wherein like parts are designated with like numerals throughout.

General Discussion

As discussed above, coal is not a uniform substance but is a mixture of components which vary in both physical and chemical composition. It is not uncommon to find as much as 22% of a sample of coal to constitute ash, with additional significant amounts of sulfur also present in the sample. If these impurities are not removed prior to their burning, they result in increased air pollution, as well as increased waste, which must later be removed. Furthermore, the heating up of the impurities in the coal requires the use of a significant amount of energy, and combustion is thus much less efficient than would be the case when burning more pure coal.

These considerations become much more important in recent years because of the frequent use of coal to power large steam turbine generators. In fact, it is not uncommon for generators in the 500 megawatt range to burn upwards of 100 tons of coal per hour. If 22% of this coal is ash, it becomes quite apparent that the handling problems and pollution involved with the ash and sulfur impurities become extremely burdensome and costly.

Prior to combustion of the coal in a typical generating operation, the coal is run through pulverizers so as to present it in the furnace in a more combustable particulate state. Due to the explosive property of coal dust or finely crushed coal particles, as well as the problems of transporting such particulate matter, the coal is pulverized into small particles just prior to combustion rather than at the coal mine.

In typical applications, the particle-laden air stream is moving at velocities on the order of 4,000 to 5,800 feet per minute. Thus, for example, in a typical coal pulverizing operation, about 15,000 cubic feet per minute is exhausted from the pulverizer through a 24 inch diameter pipe. This provides a particle carrying air stream velocity of about 4,775 feet per minute in the air passage. Since coal impurities generally have a much heavier specific gravity than the pure coal, and since the above described process produces a particle bearing air stream moving at high velocity, the application of centrifugal forces for separating the impurities from the coal is particularly well suited for use in connection with this process. Thus, through the use of centrifugal and other forces in a manner described herein, the device and method of the present invention utilize these existing conditions for optimizing the separation of impurities from the coal.

As will be described more fully hereafter, the present invention preferably utilizes a spiral loop arrangement for providing centrifugal force. Applying Newton's second law to this apparatus, the larger, more dense particles are urged toward the outer portion of the conduit by the centrifugal forces created as the particles pass rapidly through the conduit. In addition, the present invention provides for turbulent air flow within the conduit in accordance with Stokes' law, so that the lighter, less dense particles are maintained in suspension within the air stream and generally away from the periphery of the conduit.

Newton's second law states that the net force producing a change in motion is equal to the product of the mass and the acceleration of the body. Where the body is subjected to a rotating motion, this force is called centrifugal force and may be described by the equation:

$$F=Ma=(Wv^2/gr)$$

where $v$=tangential velocity $r$=radius of rotation $W/g$=Mass.

Thus, applying Newton's second law, the centrifugal force within the conduit causes the larger and denser particles to migrate more rapidly toward the outer periphery of the conduit.

Of course, under the conditions of operation in a coal-fired power plant, the fluid flow within the air passage is not laminar because the critical Reynold's number is exceeded, thereby resulting in turbulent air flow. The Reynold's number is determined according to the following formula:

$$N_{RE}=(Dvw/\mu)$$

where $D$=diameter of the conduit $v$=velocity of the air flow $w$=density of the air $\mu$=viscosity of the air.

Under these conditions which are involved in the present invention, the value of $N_{RE}$ obtained in the above equation is about $2\times10^6$ because the air flow is at 5,000 feet per minute in a 24 inch diameter pipe, which is considerably above the critical value for laminar flow within the conduit. This indicates that there necessarily is a condition of turbulent air flow in the conduit.

However, separation of the less dense particles in this turbulent air flow is effected by Stokes' law. Stokes' law defines the rate of settlement of particles in a fluid as a function of the mass of the particle and the square of its equivalent radius. Stokes' law may be set forth in equation form as follows:

$$v=[(2a^2g)/9\mu](\gamma_s-\gamma)$$

where $v$=terminal velocity of settlement in fluid $a$=radius of spherical particle $g$=acceleration $\mu$=viscosity of fluid $\gamma$=specific weight of fluid $\gamma_s$=specific weight of particle.

In application to the present invention, Stokes' law means that those particles having a greater mass (i.e., being larger or of higher density) will preferentially overcome the turbulence in the air chamber and migrate toward the periphery of the air chamber.

Therefore, by utilizing the high velocity of the particles as they are transported from the pulverizer to the furnace, the smaller, less dense particles are suspended away from the conduit walls. By properly designing the radius of rotation of the helically-shaped conduit and the velocity of the air flowing therein, the centrifugal force which is applied to the particles can be controlled so as to partially overcome the effects of turbulence in the conduit such that particles exceeding a particular mass will be directed to the outer portion of the interior surface of the conduit. In this manner a more distinct separation between particles desired to be extracted and those desired to be retained is made. Thus, blades or other extraction devices located along the outer portion of the interior surface can extract a higher percentage of the impurities from the conduit contents with only a very low percentage of the pure coal particles being included in the extracted materials.

In order to further reduce the number of coal particles which are separated, the system disclosed herein includes a collection chamber which is in fluid communication with each extraction port and which has a pressure balancing means. By use of the pressure balancing means the air pressure within the collection chamber can be made approximately equal to that within the conduit at the extraction port, thereby minimizing the passage of air through that port. By removing the pressure differential across the extraction port, the device of this invention eliminates the suction effect caused by air passing into the collection chamber which, in the prior art attempts, draws with it significant amounts of the smaller, lightweight particles.

Thus, the invention described herein provides a device and method for significantly reducing the quantity of impure particles in a particle bearing air stream. The device and method are easily adaptable for use in removing coal impurities during coal processing in many of the coal feed systems of industrial furnaces. This reduction of impurities provides for more economical burning of the coal itself, while also significantly reducing the problems involved in recovering impurities after burning and in maintaining air quality in the area surrounding the coal fired plant.

DESCRIPTION OF A PREFERRED EMBODIMENT OF THE INVENTION

Figure 2:
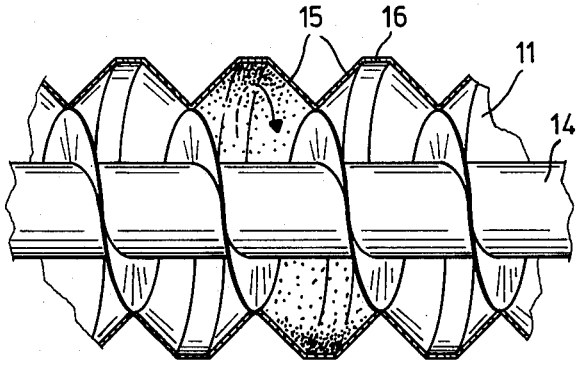
FIG. 2 is a cutaway cross-sectional view of the embodiment in FIG. 1 showing the interior of the helically-shaped air passage.

By reference to FIGS. 1 and 2, one preferred embodiment of the present invention is seen to comprise an apparatus 10 having a spiral or helically-shaped air chamber 11 with an inlet 12 and an outlet 13. Helically-shaped air chamber 11 is preferably formed around a support tube 14 or other comparable means of support. Air chamber 11 is frusto-conical in cross-section at its outer circumferential portion 15 with a truncated apex 16 terminating the frusto-conical portion and forming the outer perihery of the chamber.

In operation, a pressurized air stream having suspended particles of matter entrained therein is forced in air chamber 11 through inlet port 12. It will be appreciated that the air stream may alternatively be sucked into the chamber by applying a vacuum (not shown) at outlet port 13. The velocity of the air stream is preferably sufficient to create turbulent flow within air chamber 11 as well as creating a continuous centrifugal force which acts for a finite period of time, depending upon the velocity of the air flow and the circumferential length of the helically-shaped air chamber. The magnitude of the centrifugal force is a function of the angular velocity of the air current and its radius of rotation.

The larger or more dense particlate matter entrained in the air current is forced outwardly by the centrifugal force so as to congregate and travel adjacent the truncated apex 16 of chamber 11. The particles of smaller size or density tend to remain suspended generally away from the chamber sides in response to the eddy currents which are created by the turbulent flow of the air stream.

Figure 3:
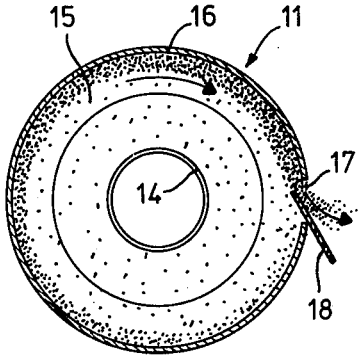
FIG. 3 is a cross-section of the embodiment of FIG. 1 taken along line 3—3, showing the concentration of larger particles toward the outer periphery of the passage and a cutting blade in position in an extraction port.
Figure 5:
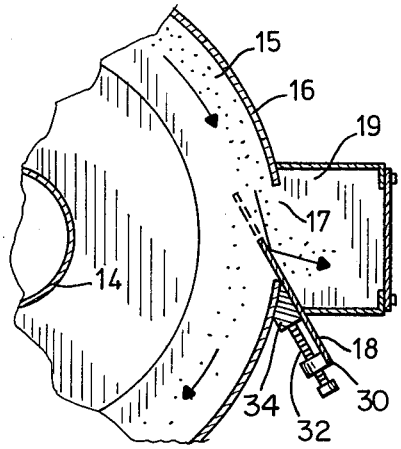
FIG. 5 is a detailed cross-sectional view of an extraction port and chamber taken along line 5—5 of FIG. 4, showing an adjustable cutting blade.

As illustrated in FIGS. 1, 3, and 5, extraction ports 17 are provided at spaced intervals along apex 16 for the purpose of extracting particles of material from the air stream within chamber 11. Each extraction port 17 is provided with an adjustable extraction blade 18 for intersecting the air stream at a predetermined depth so as to divert a portion of the airborne particles from the air stream through extraction port 17.

By providing a plurality of extraction ports 17 at periodical intervals along the air passage, more efficient collection of impurities can be obtained. Because of the dynamic and turbulent flow within the air passage, not all of the larger, more dense particles are adjacent the outer periphery of the air passage at any given time. Hence, in order to capture all of the more dense particles, multiple ports are necessary.

FIG. 5 diagramatically illustrates a proposed embodiment for adjustable blade 18, although it will be readily appreciated that a variety of constructions would be equally suitable. Adjustable blade 18, which preferably forms an acute angle with respect to the air flow within the chamber, is designed to be readily adjusted to the desired depth, thereby extracting a larger or smaller fraction of the entrained particles. More particularly, adjustable blade 18 is connected at its exterior end to a threaded collar 30 with one face slidably positioned adjacent an outer surface of an angular block 34 which is affixed to the apex 16 of chamber 11. A nut 32 extends through collar 30 so that the threaded portion of nut 32 can be in mating relationship with the threads of collar 30. Nut 32 is rotatably secured at its forward end within block 34 such that by rotating nut 32, blade 18 is caused to extend further into, or to retract away from, the interior of chamber 11.

The resistance to the flow of air through the spiral passage results in air pressures on the inside of the chamber 11 which are greater than those of the atmosphere on the outside of chamber 11. This pressure differential would normally cause a blast of air of flow outwardly from chamber 11 through extraction port 17. However, as discussed hereinbefore, it is highly desirable to prevent the smaller and lighter entrained particles from being carried out of chamber 11 by this blast of air through extraction port 17. This is accomplished by securing a collection chamber 19 to the exterior of chamber 11 so as to surround extraction port 17 and by controlling the pressure within the collection chamber to counterbalance the pressure tending to force air out of the air chamber 11 through extraction port 17.

Figure 4:
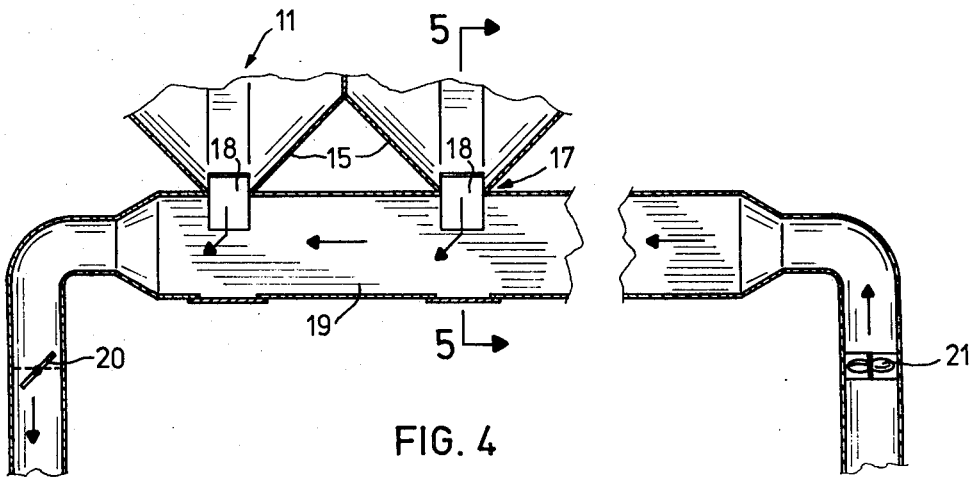
FIG. 4 is a front elevational section of an extraction chamber showing the servicing of two or more extraction ports in the air passage of FIG. 1.

FIGS. 4 and 5 illustrate one embodiment of such an extraction chamber 19 which is adapted to surround and control air pressure through a series of extraction ports 17. This embodiment of collection chamber 19 has a butterfly valve 20 at the outlet end and an independently variable blower 21 at the inlet end. The positive flow of air through extraction chamber 19 serves the dual purpose of (a) providing air pressure equalization through the relative settings of blower 21 and butterfly valve 20 to minimize the flow of air through extraction port 17, and (b) conveying the extracted particulate material to a collection point (not shown) for further processing.

Figure 6:
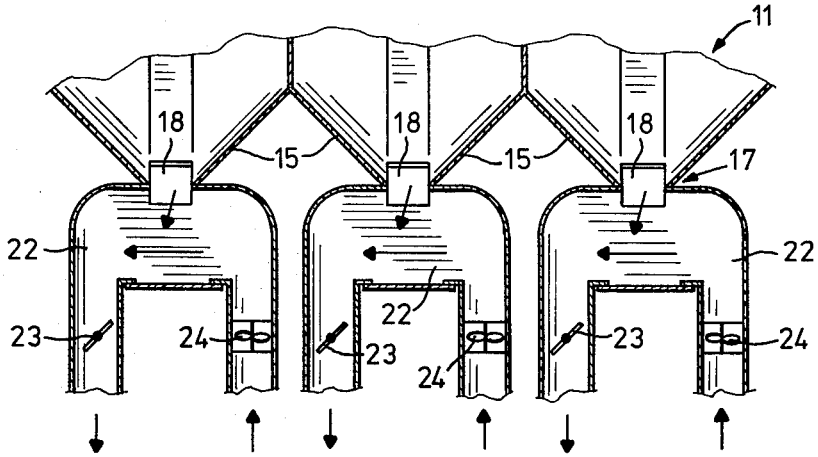
FIG. 6 is an elevational section of a series of individualized collection chambers for respective extraction ports in the air passage of FIG. 1.

Alternatively, as shown in FIG. 6, each extraction port 17 may be equipped with its own collection chamber 22 having butterfly valves 23 and blowers 24 similar to those shown and described in connection with FIGS. 4 and 5. Because the pressure within the air passage varies at different points along the conduit, this alternative arrangement allows for separate counterbalancing of the air pressure which may be present at the particular extraction port 17. Using this embodiment, the particles collected from each extraction port can be processed separately.

In practice, it is generally desirable to position at least the first blade 18 and, more desirably, all but the last blade 18, so as to extract only a small portion of the larger or more dense impurity particles and in any event, less than all of the impurity particles, so as to avoid extraction of the coal itself. In order to insure complete removal of the impurity particles, the last blade 18 (positioned closest to the outlet port 13) is extended further into chamber 11 than are the other blades 18. As a result, the particles collected through the last extraction port may include a significant amount of the fine particulate which should not otherwise be withdrawn from the air stream. Thus, as described below, provision is made in this invention to recycle this particulate back into the first portion of chamber 11 for further processing.

Figure 7:
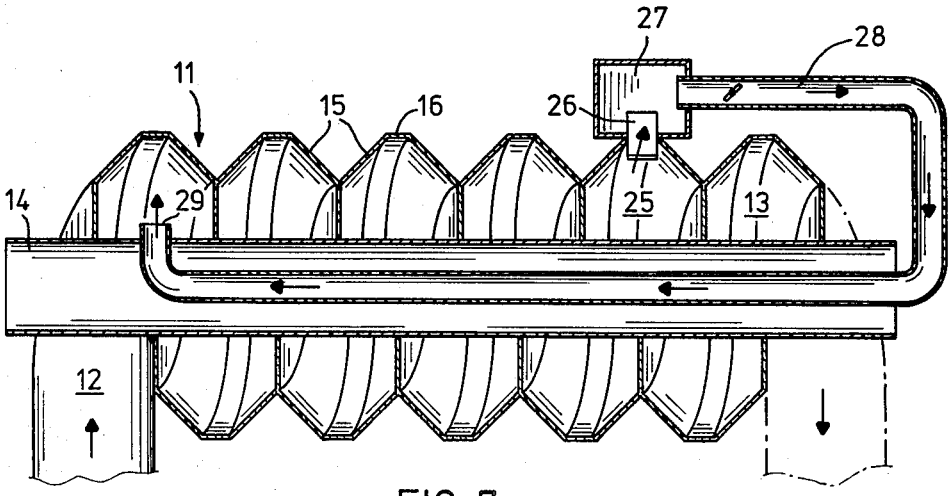
FIG. 7 is a sectional view of a preferred embodiment of the invention showing the path for recycling the final cut of particles back into the air passage of FIG. 1.

As illustrated in FIG. 7, the last extraction port 25 in air chamber 11 has an adjustable cutting blade 26 and a separate collection chamber 27. As the extracted particles are removed from air chamber 11 into collection chamber 27, they are forced through a tube 28 connected between extraction chamber 27 and an aperture 29 in support tube 14. Aperture 29 is disposed in the inner periphery of the helically-shaped air chamber, adjacent the first loop following the inlet port 12. Within chamber 11, at aperture 29, the air pressure is reduced by the vortex action of the rotating air stream. Therefore, there is a sufficient air pressure differential to effectuate injection of the particles from collection chamber 27 back into the interior of air chamber 11.

Figure 8:
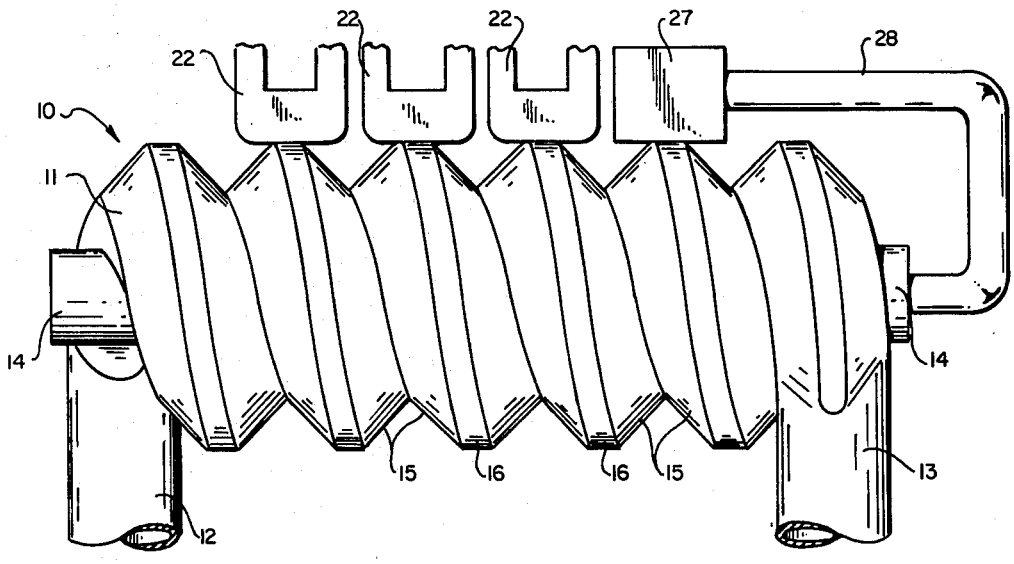
FIG. 8 is a front elevational view of the helically-shaped air passage of one preferred embodiment of the present invention, illustrating individual extraction chambers and a recycle conduit.

For purposes of illustration, FIG. 8 comprises an elevational view of the above-described embodiment of this invention, illustrating one possible arrangement of the individual collection chambers 22 and 27 and tube 28. It is noted that the positioning of extraction chambers 22 and 27 and the orientation of chamber 11 are not dependent upon the effects of gravity. At the air stream velocities discussed, the forces generated within chamber 11 are only nominally influenced by gravity, and gravity is therefore not a limiting factor in the orientation or operation of the invention.

In summary, not only does the invention described herein comprise a significant improvement over the prior art in separating particulate matter in air streams by use of centrifugal forces, but it also overcomes other long existent problems in the industry by (1) providing a means for removing the effects of pressure differential across extraction ports, (2) teaching a method by which smaller or less dense particles may be suspended away from the conduit walls in the air stream so as to more definitely separate them from the larger or more dense particles which are removed from such suspension by centrifugal forces, and (3) providing a device and method which are compatible for use with many large coal burning applications and which are capable of significantly increasing the efficiency of operation of those coal buring applications while also improving the ability to maintain high environmental quality in their surrounding area.

In addition to overcoming these problems, the device and method of this invention is very inexpensive to produce with respect to the great economic savings which are available through its use in conjunction with large industrial applications. This is particularly so because the apparatus can be placed in line utilizing existing air flow, such as between the pulverizer and burners of coal-fired power plants. Thus, when this invention is incorporated into the pulverized coal feed systems of many industrial applications such as the boiler systems of steam turbine generators, no further air source is required to effect its proper operation.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for separating particulate matter in an air stream, comprising:
   - a first chamber having inlet and outlet ports and being adapted to accommodate a particle-bearing air stream, the interior of said chamber configurated such that centrifugal forces cause at least some of said particles to travel adjacent an outer portion of said interior;
   - means disposed in the first chamber for extracting therefrom at least a portion of the particles traveling adjacent the outer interior portion of said first chamber;
   - a second chamber for receiving the extracted particles, said second chamber being in fluid communication with the extracting means; and
   - means for counterbalancing air pressure in the second chamber against air pressure within the first chamber so as to minimize air flow between said first chamber and said second chamber.

2. An apparatus as defined in claim 1 wherein the second chamber is constructed to accommodate a plurality of extracting means.

3. An apparatus as defined in claim 1 wherein the second chamber comprises:
   - an inlet and outlet port;
   - means connected to the inlet port for propelling an air stream therethrough; and
   - regulating means connected to the outlet port for controlling, in combination with said propelling means, air flow through the second chamber so as to minimize air flow between the first chamber and said second chamber.

4. An apparatus as defined in claim 1 having a plurality of extraction means, wherein the extraction means positioned closest to the outlet port of the first chamber is in fluid communication with an inlet portion of the first chamber for channeling particulate matter from the extraction means into the inlet portion, thereby recycling at least a portion of the particulate matter through the apparatus.

5. An apparatus as defined in claim 4 wherein the extraction means positioned closest to the outlet port of the first chamber is in fluid communication with an inner circumferential edge of the inlet port of the first chamber.

6. An apparatus for separating particulate matter in an air stream, comprising:

a first chamber having inlet and outlet ports and being adapted to accommodate a particle-bearing air stream, the interior of said chamber being configurated such that said air stream traverses at least one generally circular revolution so as to produce centrifugal forces which cause at least a portion of the particulate matter to travel adjacent an outer portion of said interior;

means connected to the inlet port for propelling the particle-bearing air stream therethrough;

at least one means disposed in the outer portion of the first chamber for extracting therefrom at least a portion of the particles traveling adjacent the outer portion of the interior of said first chamber; and a second chamber in fluid communication with at least one of the extracting means for receiving the extracted particles, said second chamber further comprising means for counterbalancing air pressure within the first chamber so as to minimize air flow between said first chamber and said second chamber.

7. An apparatus as defined in claim 6 wherein the interior of the first chamber is frusto-conically shaped in cross-section having an apex oriented on the outer portion of said first chamber.

8. An apparatus as defined in claim 7 wherein the apex is truncated so as to form a planar surface which is tangential to the path of travel of the air stream, said extracting means being located on said apex.

9. An apparatus as defined in claim 6 wherein the extracting means comprises a port having a blade means disposed therein, said blade means extending at least partially through said port into the interior of the first chamber.

10. An apparatus as defined in claim 9 wherein the blade means is adjustable within the port.

11. An apparatus as defined in claim 6 wherein the second chamber comprises:

a chamber having inlet and outlet ports;

means connected to said inlet port for propelling an air stream therethrough; and regulating means connected to said outlet port for controlling, in combination with said propelling means, air flow through said second chamber so as to minimize air flow therefor the first chamber and said second chamber.

12. An apparatus as defined in claim 11 wherein the second chamber is connected to the exterior of the first chamber and surrounds at least one of the extracting means.

13. An apparatus as defined in claim 11 wherein the propelling means comprises a blower and the regulating means comprises a valve assembly.

14. An apparatus as defined in claim 6 having a plurality of extraction means, wherein the extraction means positioned closest to the outlet port of the first chamber is in fluid communication with an inlet portion of the first chamber for channeling particulate matter from the extraction means into the inlet portion, thereby recycling such that at least a portion of the particulate matter through the apparatus.

15. An apparatus as defined in claim 14 wherein the extraction means positioned closest to the outflow port of the first chamber is in fluid communication with an inner circumferential edge of the intake port of the first chamber.

16. An apparatus for classifying particulate matter in an air stream, comprising:

a first chamber having inlet and outlet ports and an interior with throughbore configurated so as to define a series of spiral loops and with an outer portion formed a truncated frusto-conical shape in cross-section, said interior being adapted to accommodate a particle-bearing air stream;

an inlet blower connected to the inlet port for propelling the particle-bearing air stream therethrough;

at least one extraction port disposed in the truncated outer portion of at least one of the spiral loops;

a blade means disposed in each of the extraction ports, said blade means being adjustably positionable through said extraction port into the interior of the first channel;

at least one particle extraction chamber connected to the exterior of the first chamber and surrounding at least one of the extraction ports so as to receive extracted particles, said particle extraction chamber having inlet and outlet ports with an inlet blower connected to said inlet port and an outlet valve means connected to said outlet port, said inlet blower and said outlet valve means controlling, in combination, the air flow through said particle extraction chamber so as to minimize air flow between said first chamber and said particle extraction chamber.

17. An apparatus as defined in claim 16 having a plurality of extraction ports, wherein the extraction port positioned closest to the outlet port of the first chamber is connected through hollow pipe means to an inner circumferential edge of the inlet port of said first chamber for channeling particulate matter from said extraction port closed to the outlet port into the inlet port such that the particulate matter is recycled through the apparatus.

18. A method for separating particulate matter in an air stream, comprising the steps of:

obtaining a first chamber having inlet and outlet ports and being adapted to accommodate a particle-bearing air stream, said chamber having an interior configurated such that centrifugal forces cause at least a portion of said particles to travel adjacent a peripheral portion of said interior;

propelling a particle-bearing air stream into the inlet port of the first chamber;

extracting from the first chamber at least a portion of the particles traveling adjacent the periphery of the first chamber;

receiving the particles in a second chamber which is in fluid connection with the first chamber; and controlling air flow and air pressure within the second chamber so as to carry the received particles out of said second chamber and so as to minimize air flow between the first chamber and said second chamber.

19. A method as defined in claim 18 wherein the propelling step comprises propelling the particle-bearing air stream with sufficient velocity to cause turbulance in the air stream within the first chamber so as to encourage at least a portion of the particles to remain suspended within said air stream and away from the outer portion of said first chamber.

20. A method as defined in claim 18 wherein the extracting step comprises:

extracting particles from more than one location in the first chamber; and transferring those particles collected nearest the outlet port of the first chamber into an inlet portion of the first chamber such that the particulate matter is recycled through the first chamber.

21. A method as defined in claim 20 wherein the collected particles are transferred through a port in the inner circumferential edge of the intake port of the first chamber.

22. A method as defined in claim 18 wherein said extracting step further comprises the steps of:

extending a blade means at least partially through an extraction port disposed in the outer portion of said first chamber such that the blade means extends into the interior of the first chamber; and deflecting at least a portion of the particles within the first chamber through the extraction port and into the second chamber.

23. A method as defined in claim 18 wherein said controlling step further comprises the step of operating, in combination, a blower connected to an inlet port in the second chamber and a valve means connected to an outlet port in the second chamber so as to transfer the extracted particles through the interior of the second chamber and so as to approximately balance air pressure within the second chamber with air pressure near the fluid connection in the first chamber.

* * * * *

UNITED STATES PATENT AND TRADEMARK OFFICE

CERTIFICATE OF CORRECTION

PATENT NO. : 4,383,917

DATED : May 17, 1983

INVENTOR(S) : Howard M. Wells

It is certified that error appears in the above—identified patent and that said Letters Patent is hereby corrected as shown below:

Column 2, line 49, "particlate" should be --particulate--

Column 5, line 38, "combustable" should be --combustible--

Column 7, line 50, "perihery" should be --periphery--

Column 9, line 66, "buring" should --burning--

Column 11, line 47, Claim 11, "therefor" should be --between--

Column 11, line 62, Claim 14, delete "such that"

Column 12, line 6, Claim 16, "formed a" should be --formed in a--

Signed and Sealed this

Ninth Day of August 1983

[SEAL]

*Attest:*

GERALD J. MOSSINGHOFF

*Attesting Officer*

*Commissioner of Patents and Trademarks*